US005307716A

United States Patent [19]

Onishi et al.

[11] Patent Number: 5,307,716

[45] Date of Patent: May 3, 1994

[54] SHEET MATERIAL CUTTING DEVICE

[75] Inventors: Takamasa Onishi; Zentaro Kamura, both of Gunma, Japan

[73] Assignees: Onishilite Industry Co., Ltd., Gunma; Sumitsu & Co., Ltd., Osaka, both of Japan

[21] Appl. No.: 978,735

[22] Filed: Nov. 19, 1992

[30] Foreign Application Priority Data

Nov. 29, 1991 [JP] Japan ..... 3-339402
Jul. 30, 1992 [JP] Japan ..... 4-222295

[51] Int. Cl.[5] ..... B26D 1/18; B26D 1/20

[52] U.S. Cl. ..... 83/488; 83/508; 83/582; 83/614

[58] Field of Search ..... 83/488, 489, 496, 508, 83/614, 582

[56] References Cited

U.S. PATENT DOCUMENTS 1,735,520 11/1929 Williams ..... 83/508
3,766,816 10/1973 Loveless ..... 83/508
4,046,044 9/1977 Paterson et al. ..... 83/508
4,383,458 5/1983 Kitai et al. ..... 83/614
4,448,101 5/1984 Templeton ..... 83/508
4,665,787 5/1987 Arnold et al. ..... 83/508

*Primary Examiner*—Hien H. Phan
*Attorney, Agent, or Firm*—Beveridge, DeGrandi, Weilacher & Young

[57] ABSTRACT

A sheet material cutter which cuts a sheet material by the cooperation of a circular rotary cutting blade moving while rotating and a long sheet-shaped fixed cutting blade, and provides a sheet material cutter, having a simple construction. The device permits satisfactory cutting of a strip-shaped sheet material such as paper by simply causing the rotary cutting blade to incline by an angle necessary for cutting, both in forward and backward motions of the rotary cutting blade, by the cooperation of the circular rotary cutting blade moving while rotating, a roller for rotating this rotary cutting blade and a roller guide.

13 Claims, 12 Drawing Sheets

SHEET MATERIAL CUTTING DEVICE

BACKGROUND OF THE INVENTION

The present invention relates to a sheet material cutting device or cutter which cuts a sheet material by the cooperation of a circular rotary cutting blade moving while rotating and a fixed cutting blade formed into a long sheet.

In a printer for a terminal such as ECR or POS, a strip-shaped sheet material wound into a roll is pulled out for printing, and then the necessary portion is cut by a cutter into a sheet for delivery.

Various types of such sheet material cutters are available. The rotary-type cutter requires a high manufacturing cost and causes a relatively high degree of noise and therefore is now being replaced by a cutter based on a combination of a circular rotary cutting blade moving while rotating and a fixed cutting blade formed into a long sheet.

The prior art cutters of this type will be described below with reference to FIG. 11. A support 101 having a rotary cutting blade 102 horizontally travels on a screw shaft 100 as shown in FIG. 11 (*a*). As is clear from FIG. 11 (*b*), the rotary cutting blade 102 is rotatably bearing-supported on a shaft 105 which is on the support 101, and pressed against a fixed cutting blade 103 by means of a spring, for example. A sheet material transferred vertically in FIG. 11 (*a*) is cut by the rotary cutting blade 102 and the fixed cutting blade 103 while the support 101 travels horizontally.

In this cutter, it is important for ensuring satisfactory cutting to cause the rotary cutting blade 102 to slightly incline relative to the fixed cutting blade 103 as shown in FIGS. 12 and 13 so that the periphery of the rotary cutting blade 102 is brought into pressure-contact with the edge portion of the fixed cutting blade 103 at a point P in the travelling direction of the rotary cutting blade 102. Particularly, in order to permit cutting of the sheet material S not only during forward motion of the rotary cutting blade 102, but also during backward motion thereof, it is necessary to provide an apparatus having a means to switch over the inclination of the rotary cutting blade 102 between forward and backward motions. For example, Japanese Patent Publication No. 50-24,466 proposes such as apparatus.

This prior known cutter of sheet material will be described below. FIG. 14 is a perspective view illustrating a schematic construction of the conventional sheet material cutter, and FIG. 15 is a plan view illustrating the cutter of FIG. 14 as viewed from above. In these drawings, S is a sheet material such as paper; 41 is a fixed cutting blade in the form of a long sheet provided under the sheet material S; 41*a* is the upper surface of the fixed cutting blade 41, and 41*b* is the edge portion thereof; 42 is a guide rail installed so as to be in parallel with the edge portion 41*b* of the fixed cutting blade 41 above the sheet material S; 43 is a supporting member of a rotary cutting blade, which is loosely fitted in the guide rail 42; 44 is a rocking lever rockably fitted to the upper front portion of the rotary cutting blade supporting member 43; 45 is a pin making the rocking lever 44 rockable; 46 and 47 are pins limiting rocking of the rocking lever 44; 48 is a shaft fixed to the front portion of the rocking lever 5; 49 is a spring fitted in the shaft 48; 51 is the rotary cutting blade rotatably fitted to the tip of the shaft 48; 54 is a pin fixed to the upper rear end portion of the rocking lever 44; and 55*a* and 55*b* are wires secured each at an end to the pin 54.

Now, the operation of the prior known sheet material cutter having the construction as mentioned above will be described.

First, the sheet material S is fed in proximity to the upper surface 41*a* of the fixed cutting blade 41 and kept stationary there. The spring 49 presses the rotary cutting blade 51 with the edge portion directed forward, and as a result, the peripheral portion of the rotary cutting blade 51 is always in pressure-contact with the edge portion 41*b* of the fixed cutting blade 41. The wires 55*a* and 55*b* are stretched along the guide rail 42. These wires are adapted to be horizontally stretched alternately for each cutting step by means of a driving mechanism (not shown). FIG. 14 illustrates the wire 55*b* as pulled to the left. The rotary cutting blade supporting member 43 therefore travels by being pulled through the rocking lever 44 by the wire 55*b* in this direction. As a result, the rotary cutting blade 51 also travels to the left.

Upon this travel, the rocking lever 44 rocks clockwise around the pin 45, and the rear end portion of the rocking lever 44 comes into pressure-contact with the pin 47. Consequently, the rotary cutting blade 51 is kept in inclination of the end face thereof by an angle q relative to the edge portion 41*b* of the fixed cutting blade 41. The rotary cutting blade 5 therefore travels while keeping the leading head portion thereof in the travelling direction in point-contact with the edge portion 41*b* of the fixed cutting blade 41. Along with travel of the rotary cutting blade 51, the sheet material S is cut from right in FIG. 15 by the peripheral portion of the rotary cutting blade 51, which is in point-contact with the edge portion 41*b* of the fixed cutting blade 41.

Upon the completion of a cycle of cutting step as mentioned above, the wire 55 is pulled toward the right in FIG. 14. When the wire 55 is pulled toward the right in FIG. 14, then the rocking lever 44 rocks anti-clockwise around the pin 45. As a result, the rocking lever 44 brings the rear end portion thereof into pressure-contact with the pin 46. The end face of the rotary cutting blade 51 thus inclines in the direction opposite to that described above, so that the peripheral portion of the rotary cutting blade 51 comes into point-contact with the edge portion of the fixed cutting blade 41 at the right-hand portion thereof. The sheet material S in stoppage for a prescribed period of time is cut by the travel of the rotary cutting blade 51 to the right in FIG. 15.

In the above-mentioned cutter, however, it is necessary to provide wires horizontally stretched and a rocking lever rocking around a fulcrum shaft, and switching of the inclining direction of the rotary cutting blade requires a complicated construction, leading to an expensive apparatus.

SUMMARY OF THE INVENTION

With a view to solving these conventional problems, the present invention has an object to provide a sheet material cutter which permits cutting satisfactorily a strip-shaped sheet material such as paper while simply causing a rotary cutting blade to incline by an angle necessary to cutting both in forward and backward travels of the rotary cutting blade by the cooperation of the circular rotary cutting blade which travels while rotating, a roller for the rotation of the rotary cutting blade and a roller guide.

When a motor not shown is started to rotate the screw shaft 6 and the supporting member 2 begins travelling toward the left in FIG. 2 the roller 11 moves to the position indicated by the solid line in FIG. 2 in a roller groove 12 while rotating in the space between a rotary cutting blade 1 and a roller guide 8 until the shaft of the roller 11 hits a stopper 13. Under the effect of this motion of the roller 11, the rotary cutting blade 1 is supported at points P and Q, and inclines by the rotation moment produced relative to the support axis, thus being always pressed against a fixed cutting blade 4 at a contact point P. When the supporting member 2 further continues to move toward the left along a frame 3, the roller 11 rotates through frictional force with the roller guide 8. As a result, the sheet material located between the fixed cutting blade 4 and the rotary cutting blade 1 is cut by the cooperation of the both cutting blades while maintaining an appropriate angle between the both cutting blades. According to the present invention, as described above, it is possible to satisfactorily cut a strip-shaped sheet material such as paper while simply causing the rotary cutting blade to incline by an angle necessary for cutting both in forward and backward motions thereof.

DESCRIPTION OF PREFERRED EMBODIMENT

The first embodiment of the present invention will now be described with reference to the drawings.

Figure 1:
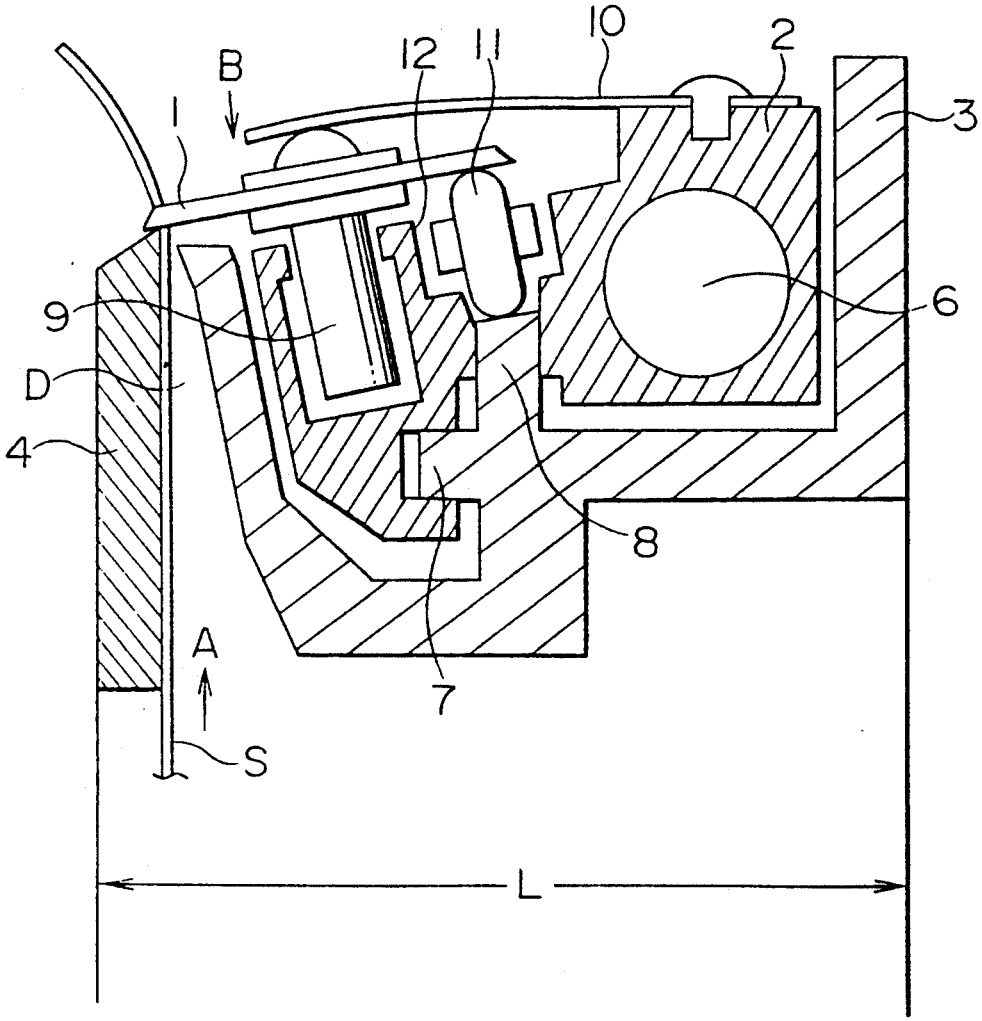
FIG. 1 is an enlarged sectional view illustrating a first embodiment of the sheet material cutter of the present invention.
Figure 2:
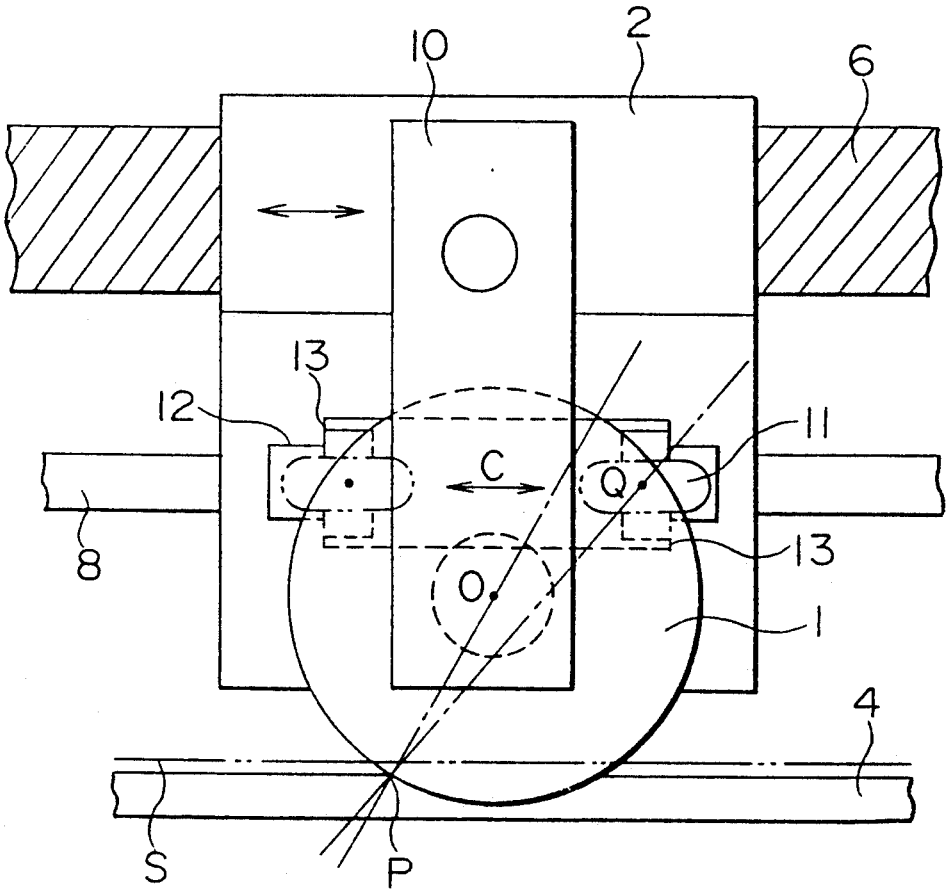
FIG. 2 is a plane view of the sheet material cutter of the first embodiment of the present invention.

FIG. 1 is an enlarged sectional view illustrating the first embodiment of the sheet material cutter of the present invention, and FIG. 2 is a plane view of FIG. 1.

In FIG. 1, 3 is a frame, and 4 is a fixed cutting blade. The frame 3 and the fixed cutting blade 4 are fixedly supported on the both end plates of a sheet material cutter not shown. Also in FIG. 1, S is a sheet material to be cut, which is fed in the arrow direction in the drawing through a gap D formed by the frame 3 and the fixed cutting blade 4. The frame 3 has a guide 7 and a roller guide 8 formed in the longitudinal direction thereof. A supporting member 2 is slideably fitted to the guide 7 and the roller guide 8 so as to prevent occurrence of play in the supporting member 2.

A screw shaft 6 engages with the supporting member 2 for causing the supporting member 2 to travel. A driving mechanism not shown such as a motor is connected to this screw shaft 6. When this screw shaft 6 is rotated by the motor not shown or the like, therefore, the supporting member 2 can freely slide along the screw shaft 6 in the axial direction thereof.

A rotary cutting blade 1 is rotatably bearing-supported by the supporting member 2 by means of a shaft 9, and the shaft 9 is loosely attached to the supporting member 2 so as to be capable of slightly inclining relative to the supporting member 2. The rotary cutting blade 1 is adapted to be supported, in the assembled state, by the fixed cutting blade 4 and a roller 11 described later with the points P and Q in FIG. 2 as the fulcrums. The rotary cutting blade 1, which is attached at an angle to the fixed cutting blade 4 as shown in FIG. 1, may be attached substantially at right angles as before. When the rotary cutting blade 1 is attached at an angle as in this embodiment, however, it is possible to reduce the width L of the cutter, and hence to achieve a more compact cutter.

A roller groove 12 is formed in the shape as shown in FIG. 2 in the supporting member 2, and the roller 11 is arranged in this groove 12 so as to allow reciprocation of the roller 11 in the arrow C direction. The above-mentioned roller groove 12 is formed in parallel with the travelling direction of the supporting member 2, and stoppers 13 are formed at the both ends of the roller groove 12. These stoppers 13 have the function of preventing the roller 11, when the roller 11 shaft comes into contact with the stopper, from further travelling in the groove 12. The roller 11 is rotatably held at the position where the roller shaft has come into contact with the stopper 13.

The position of the above-mentioned stopper 13 formed in the roller groove 12 is such that the point where the roller 11 arranged in the roller groove 12 is in contact with the back surface of the rotary cutting blade 1 is behind the gravitational center line connecting the contact point P between the rotary cutting blade 1 and the fixed cutting blade 4 and the center of rotation 0 of the rotary cutting blade 1 in the travelling direction of the supporting member 2 (on the right-hand side of the gravitational center line in FIG. 2) and where the above-mentioned point Q does not come off the rotary cutting blade 1. In this arrangement, in the state in which the supporting member 2 travels toward the left in FIG. 2, for example, the rotary cutting blade 1 is supported at the two points P and Q, and always receives the moment of the fixed cutting blade 4 pressing same around the support axis PQ. The rotary cutting blade 1 thus inclines to be always pressed against the contact point P with the fixed cutting blade 4. When the supporting member 2 travels in the direction opposite to that mentioned above, the roller 1 moves to the position indicated by the two-point chain line in FIG. 2, thus causing the rotary cutting blade 1 to incline in the direction opposite to that mentioned above.

The above-mentioned roller 11 is on the other hand arranged between the rotary cutting blade 1 and the roller guide 8 as shown in FIG. 1, and is brought into pressure-contact through the rotary cutting blade 1 with the roller guide 8 under an appropriate pressure provided by the spring force B of the pressing spring 10. When the supporting member 2 begins travelling, therefore, the roller 11 moves while rotating under the effect of frictional force with the guide roller 8 to come into contact with the stopper 13 in the roller groove 12. In this state, rotation of the rotary cutting blade 1 is caused by the rotation of the roller 11. As described above, the roller 11 has the function of communicating rotation force to the rotary cutting blade 1 by the action of frictional force between the roller 11 and the roller guide 8 and between the roller 11 the rotary cutting blade 1. The back surface of the rotary cutting blade 1, the surface of the roller 11 and the surface of the roller guide 8 should preferably be kept in the state capable of generating appropriate frictional force.

The operation of the sheet material cutter having the construction as mentioned above will now be described with reference to FIG. 2.

Let us consider first the case where the supporting member 2 travels along the frame 3 toward the left in FIG. 2. When a motor not shown in started to cause the screw shaft 6 to rotate and the supporting member 2 to begin travelling toward the left in FIG. 2, the roller 11 moves to the position indicated by the solid line in FIG. 2 in the roller groove 12, while rotating between the rotary cutting blade 1 and the roller guide 8 until the roller 11 shaft comes into contact with the stopper 13. By this movement of the roller 11, the rotary cutting blade 1 is supported at the points P and Q, and rotational moment generated relative to the supporting axis causes the rotary cutting blade 1 to incline to be pressed against the contact point P with the fixed cutting blade 4.

When the supporting member 2 further continues to move toward the left along the frame 3 in this state, the roller 11 rotates under the effect of frictional force with roller guide 8, and rotation of the roller 11 causes the rotary cutting blade 1 to rotate in the travelling direction of the supporting member 2. As the supporting member 2 thus moves toward the left, the rotary cutting blade 1 also rotates anti-clockwise, and it is possible to cut the sheet material located between the rotary cutting blade 1 and the fixed cutting blade 4 by the cooperation of the both cutting blades while keeping an appropriate angle between the fixed cutting blade 4 and the rotary cutting blade 1. When the sheet material is cut and the supporting member 2 moves to an end of screw shaft, the supporting member 2 remains in this state until the next sheet material is fed. When the sheet material is fed, the screw shaft 6 rotates now in the direction opposite to that mentioned above, driven by the motor not shown. This rotation causes the supporting member 2 to begin traveling toward the right in FIG. 2, and the sheet material is cut in a manner similar to that described above. In this case, the rotary cutting blade 1 inclines in the direction opposite to that described above and rotates in the traveling direction of the supporting member 2 while maintaining an appropriate angle to the fixed cutting blade 4.

In the first embodiment of the present invention, as described above, it is possible to cut the sheet material by means of the rotary cutting blade 1 during travel of the supporting member 2 on the screw shaft, whether forward or backward, and to cause the rotary cutting blade 1 to incline at an appropriate angle to the fixed cutting blade 4 in response to the direction of travel of the supporting member 2, thus making it possible not only to achieve an improved cutting efficiency of sheet material, but also to obtain a very clear cut face.

When the supporting member 2 is to reverse the traveling direction thereof, in the above-mentioned first embodiment, the roller 11 first moves in the roller groove 12 while rotating between the rotary cutting blade 1 and the roller guide 8 until the roller 11 shaft hits the stopper 13. More specifically, when the supporting member 2 is to move from the state shown in FIG. 2 toward the right in the drawing, initial movement of the supporting member 2 causes the roller 11 to travel from the solid line position to the two-point chain line position in FIG. 2. In the state in which the roller shaft comes in contact with the stopper on the opposite side, the rotary cutting blade 1 inclines under the effect of rotation moment produced relative to the support axis, and is pressed against the contact point P with the fixed cutting blade 4. In this state, the supporting member 2 further moves and the roller causes the rotary cutting blade to rotate to start the next cycle of sheet cutting. In this embodiment, however, the sheet material is not cut during travel of the roller in the roller groove, and this embodiment is thus defective in that this movement process of the roller 11 is of no use. In addition, the necessity to keep the space for the movement of the roller inevitably results in a longer traveling distance of the supporting member, thus making it difficult to achieve a smaller-sized sheet material cutter.

The sheet material cutter of the second embodiment is therefore to provide a sheet material cutter which permits minimization of the play occurring when reversing the traveling direction as in the first embodiment, by forcedly causing the shaft 9 of the rotary cutting blade 1, upon reversal of the traveling direction of the supporting member, to incline in the opposite direction through movement of the traveling member 14.

The second embodiment of the present invention will now be described with reference to the drawings.

Figure 3:
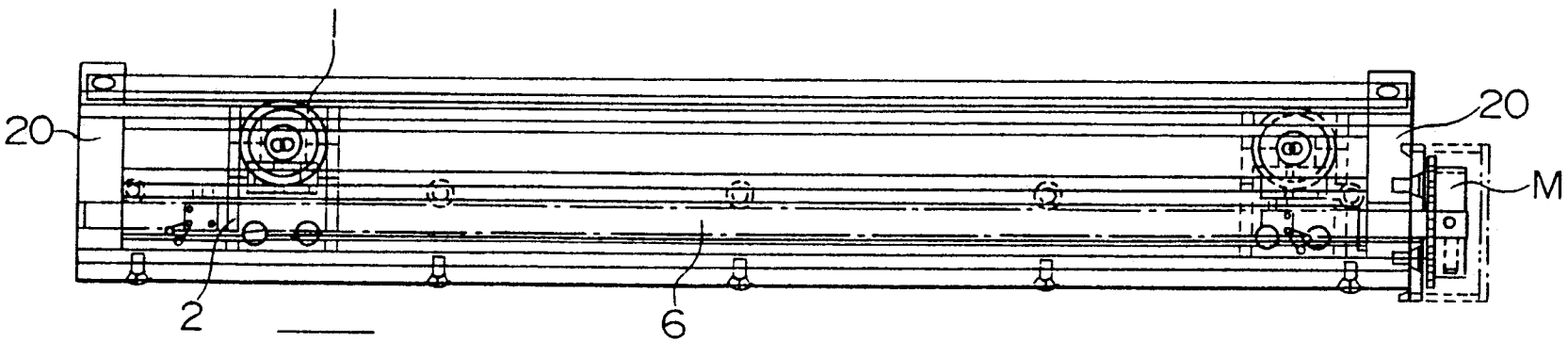
FIG. 3 is while plane view illustrating a second embodiment of the sheet material cutter of the present invention.
Figure 4:
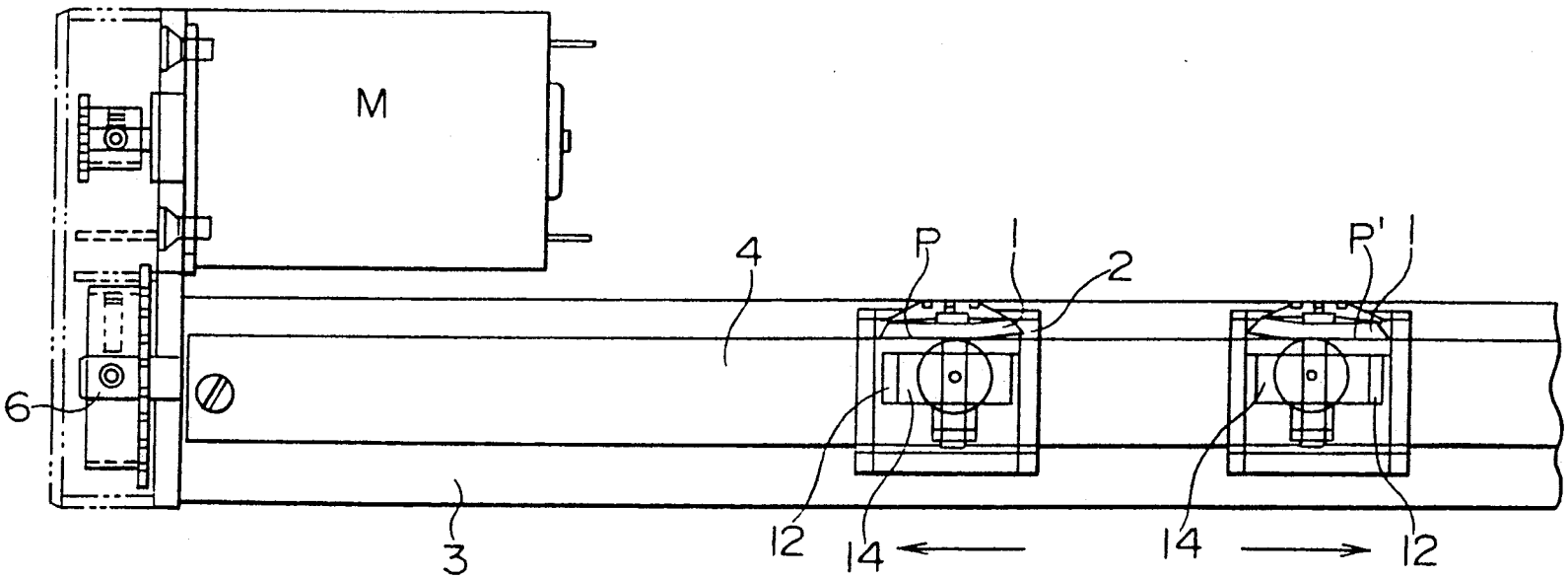
FIG. 4 is a descriptive view of operation of the rotary cutting blade in reciprocation of the sheet material cutter of the second embodiment of the present invention.
Figure 5:
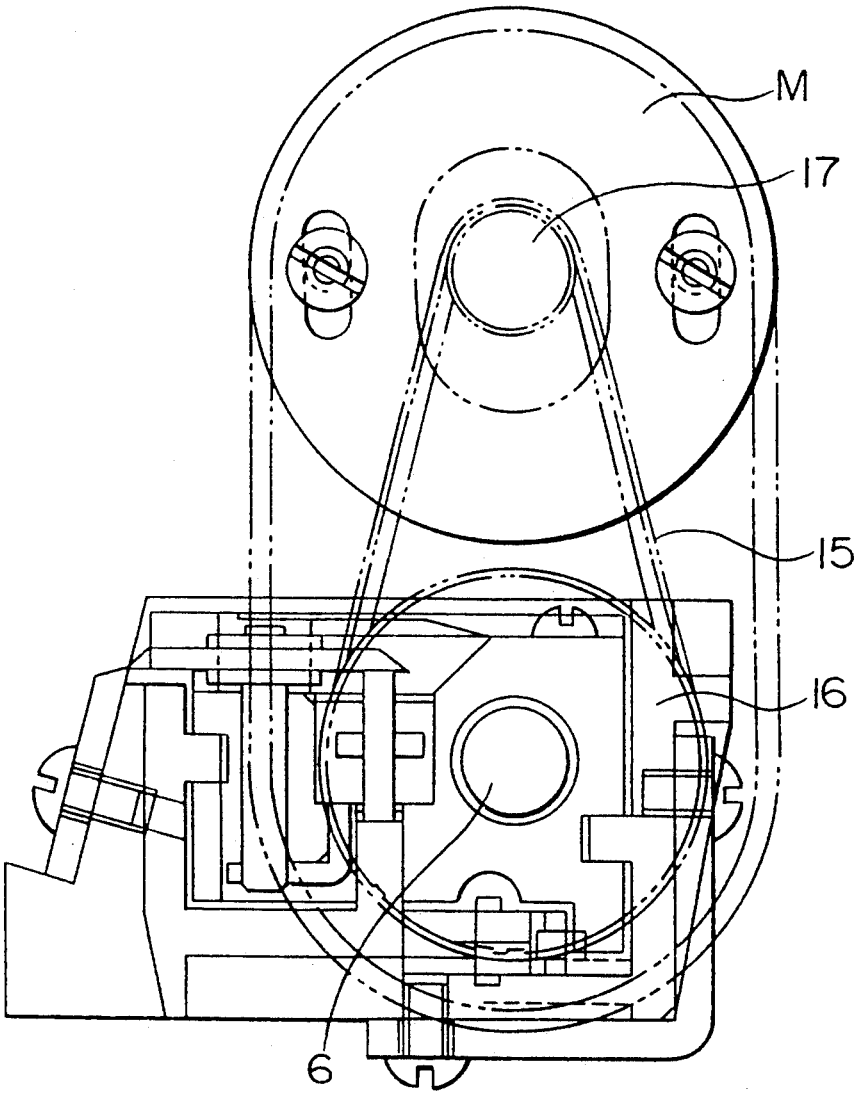
FIG. 5 is a side view illustrating the sheet material cutter of the second embodiment of the present invention.
Figure 6:
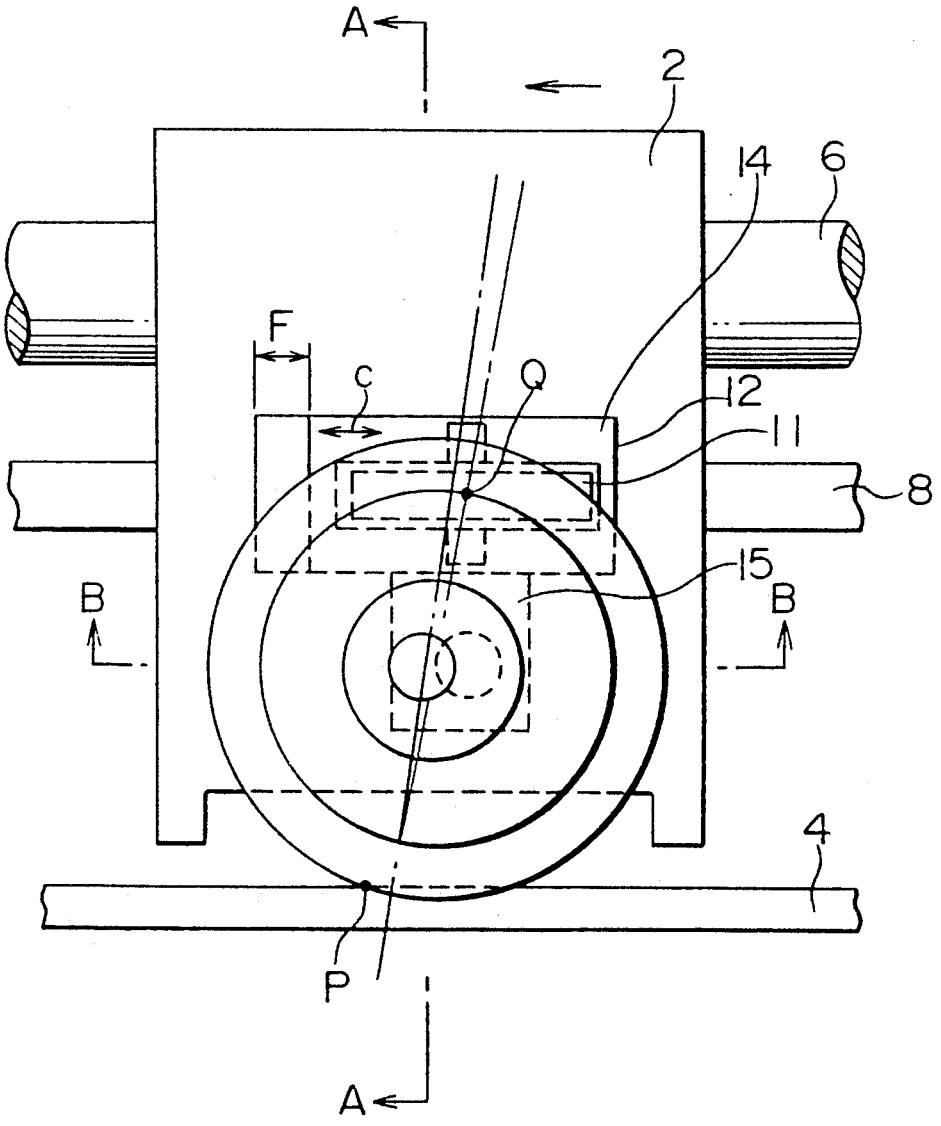
FIG. 6 is a plane view illustrating the sheet material cutter of the second embodiment of the present invention.
Figure 7:
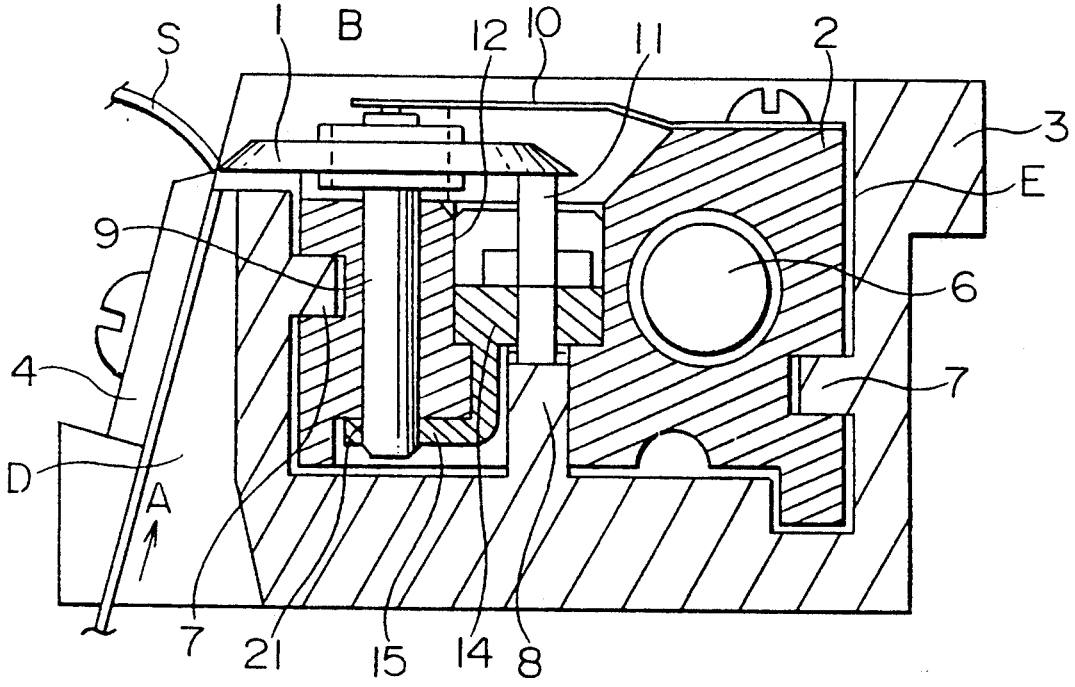
FIG. 7 is a partially cutaway sectional view of FIG. 6 cut along the line A—A.
Figure 8:
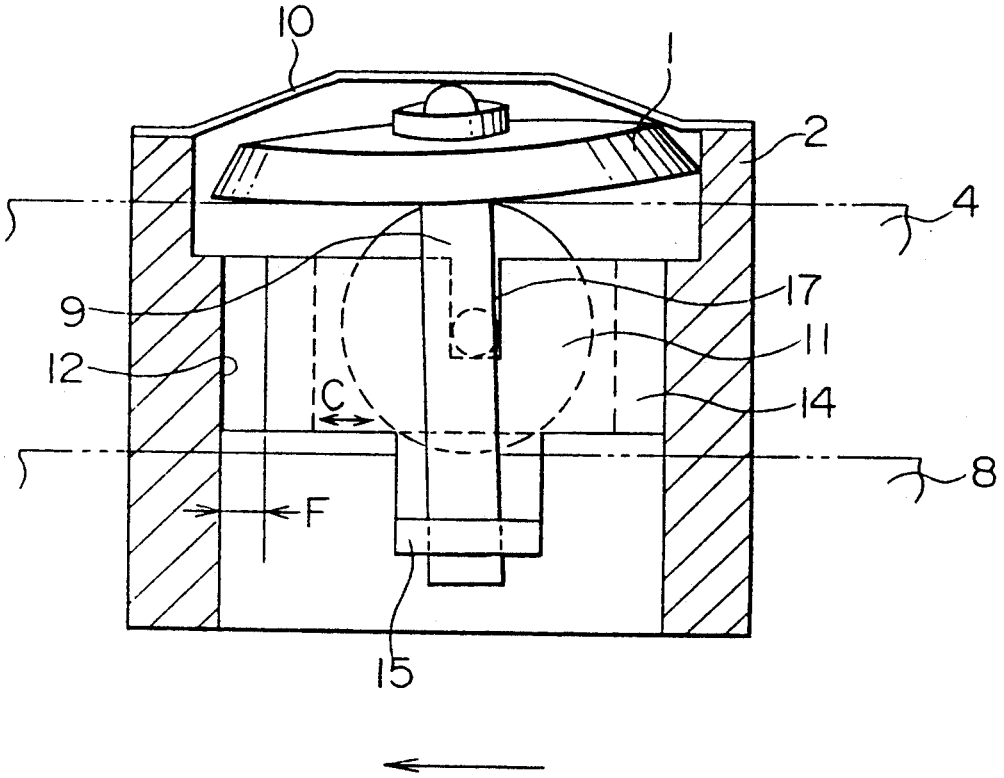
FIG. 8 is a partially cutaway sectional view of FIG. 6 cut along the line B—B.

For the purpose of describing the second embodiment, the drawings are as follows: FIG. 3 is a whole plan view illustrating the sheet material cutter of the second embodiment of the present invention; FIG. 4 is a descriptive view illustrating operation of the rotary cutting blade in reciprocation of the sheet material cutter of the second embodiment of the present invention; FIG. 5 is a side view illustrating the sheet material cutter of the second embodiment of the present invention; FIG. 6 is a plan view of the sheet material cutter of the second embodiment of the present invention; FIG. 7 is a partially cutaway enlarged sectional view of FIG. 6 cut along the line A—A, and FIG. 8 is a partially cutaway enlarged sectional view of FIG. 6 cut along the line B—B.

In FIG. 3, the sheet material cutter of the second embodiment has, as in that of the first embodiment, a supporting member 2 provided horizontally movable on a screw shaft 6 in the drawing, and a rotary cutting blade 1 provided on this supporting member 2. The supporting member 2 engages with the screw shaft 6, and sprockets 16 are provided in this screw shaft 6 as shown in FIG. 5. The supporting member 2 can freely slide along the screw shaft in the axial direction thereof (perpendicularly to the sheet plane of FIG. 7) by rotating these sprockets 16 by means of a belt 15 stretched between, and wound around the sprockets 16 and sprockets 17 of the motor shaft, whereby the rotary cutting blade 1 cuts the sheet material.

The above-mentioned sheet material cutter will be described further in detail. In FIG. 7, 3 is a frame; 4 is a fixed cutting blade fixed to this frame 3; and the frame 3 is fixedly supported on the both end plates 20 and 20 (shown in FIG. 3) of the sheet material cutter Also in FIG. 7, S is a sheet material to be cut, which is to be fed in the arrow A direction in the drawing from a gap D formed by the frame 3 and the fixed cutting blade 4. A groove E for accommodating the supporting member 2 is provided in the frame 3 in the axial direction thereof, guides 7 and 7 are formed on the surfaces opposed to each other of this groove E, and a roller guide 8 is formed on the bottom surface thereof. The supporting member 2 is slidably attached at right angles to the drawing plane to these guides 7 and the roller guide 8. The guides 7 and the roller guide 8 support the supporting member 2 in a state free from "play" relative to the frame 3.

The rotary cutting blade 1 is ratably bearing-supported on the supporting member 2 by means of a shaft 9, which is loosely fitted to the supporting member 2 so as to form a slight angle to the supporting member 2. The lower end of this shaft 9 is bearing-supported by a supporting arm 15 integrally formed with a traveling member 14 described later. When traveling toward the left in FIG. 6, the rotary cutting blade 1 is supported by the fixed cutting blade 4 and a roller 11 described later at points P and Q in FIG. 6.

A roller groove 12 in parallel with the traveling direction of the supporting member 2 as shown in FIG. 6 is formed in the supporting member 2. The traveling member 14 is arranged in the groove 12 so as to be reciprocatively movable within a gap F in the arrow C direction. The gap F between the traveling member 14 and the groove 12 suffices to have a size sufficient to allow inclination of the shaft 9 of the rotary cutting blade 1 by a prescribed angle, and as is clear from FIG. 8, this gap F may be reduced in size according as the shaft 9 has a shorter length. A roller 11 is bearing-supported by the traveling member 14, which is bearing-supported by a notch 17 (see FIG. 8). The roller 11 is rotatable only within the traveling member 14. The roller 11 projects above and below the traveling member 14 a shown in FIG. 8, and rotates while coming into contact with the rotary cutting blade 1 and the roller guide 8.

Now, the construction of the traveling member 14 will be described further in detail.

Figure 9:
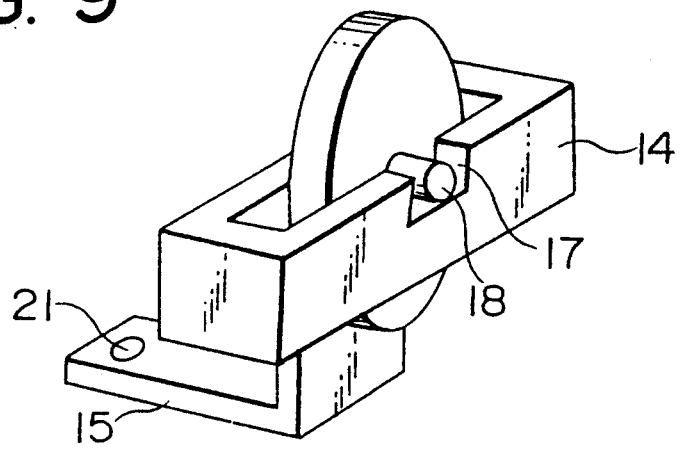
FIG. 9 is a perspective view illustrating the travelling members used in the second embodiment.
Figure 10:
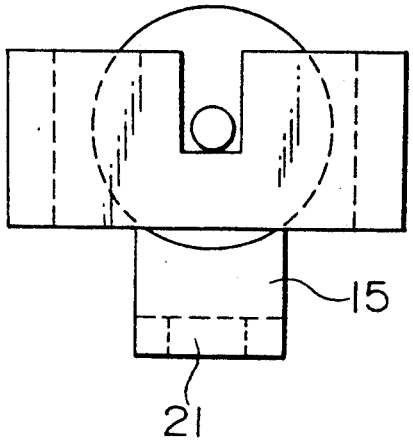
FIG. 10 contains a front view and a side view illustrating the travelling members used in the second embodiment.
Figure 10:
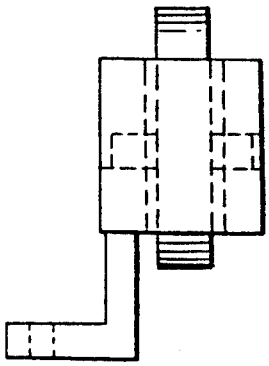
Figure 11:
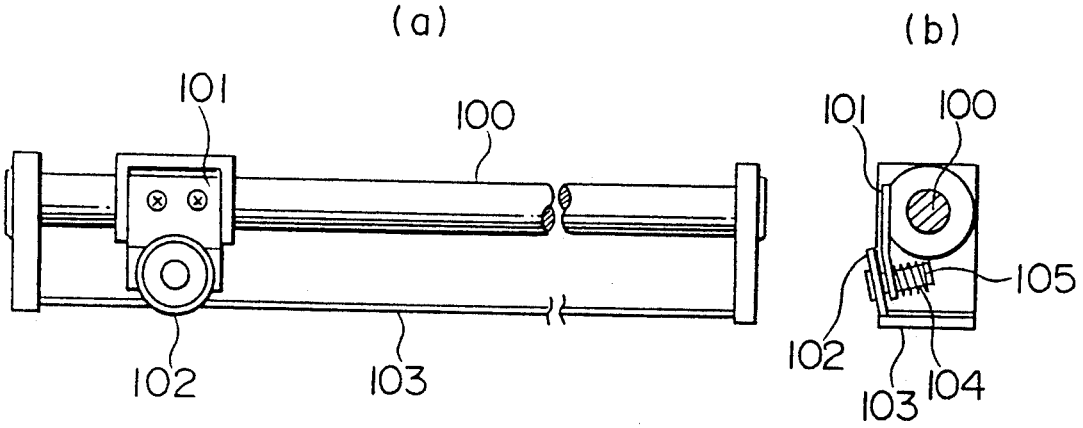
PRIOR ART FIG. 11
FIG. 11 is a schematic configurational view of the conventional sheet materials cutter.
Figure 12:
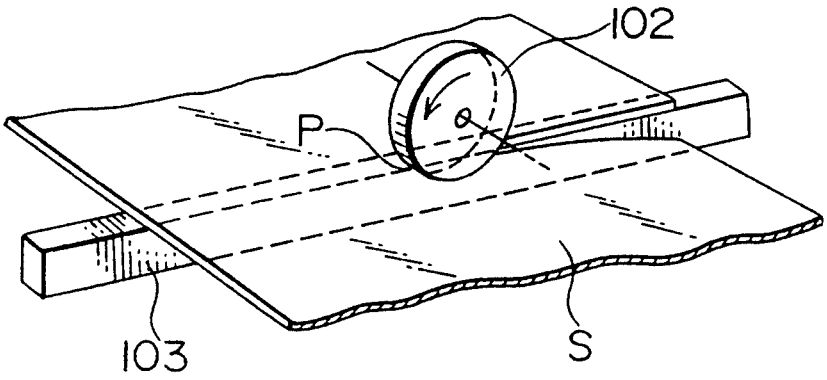
PRIOR ART FIG. 12
FIG. 12 is a descriptive view of operation of the rotary cutting blade of the conventional sheet material cutter.
Figure 13:
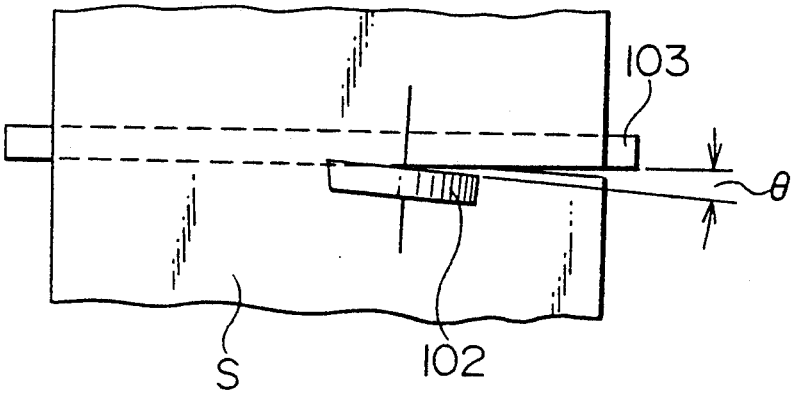
PRIOR ART FIG. 13
FIG. 13 is a plane view illustrating the operation of the rotary cutting blade of the conventional sheet material cutter.
Figure 14:
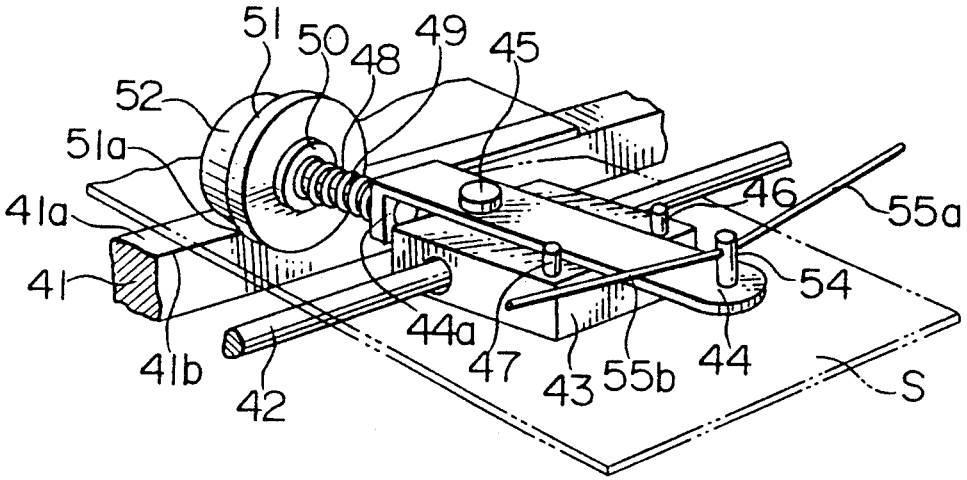
PRIOR ART FIG. 14
FIG. 14 is a perspective view illustrating the conventional sheet material cutter.
Figure 15:
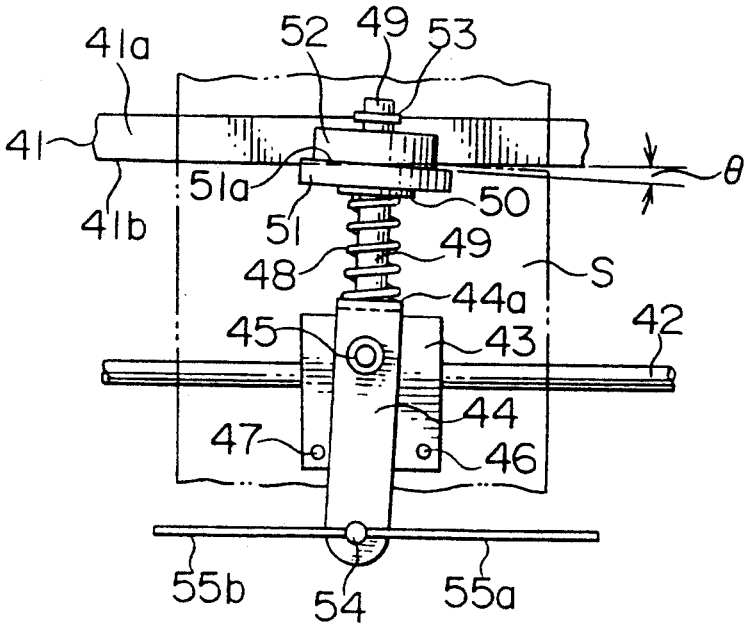
PRIOR ART FIG. 15
FIG. 15 is a plane view illustrating the conventional sheet material cutter.

The traveling member 14 has a shape as shown in FIGS. 9 and 10, and the bottom portion thereof is formed integrally with the supporting arm 15. A hole 21 for engaging the rotation shaft 9 of the rotary cutting blade 1 is formed in this supporting arm 15. The traveling member 14 having the construction as described above engages with the groove 12 as mentioned above, and reciprocatively travels in the groove 12 while keeping the lower end of the rotation shaft 9 within the hole 21. When the traveling member 14 moves in the roller groove 12 in the arrow C direction in FIGS. 6 and 8, therefore, the lower end of the shaft 9 of the rotary cutting blade 1 also moves with the travel of the traveling member 14, and the contact point between the rotary cutting blade 1 and the roller 11 also moves from the center line to one side. The rotary cutting blade 1 thus inclines in the traveling direction of the supporting member 12.

In FIG. 6, for example, with the constructions as described above, in the state in which the supporting member 2 moves toward the left in the drawing, the rotary cutting blade 1 is supported at the two points P and Q, and the lower end of the shaft 9 moves to the side opposite to the traveling direction. The rotary cutting blade 1 therefore inclines so as to be always pressed against the contact point P with the fixed cutting blade 4. When the supporting member 2 moves in the direction opposite to that mentioned above, the rotary cutting blade 1 inclines in the direction opposite to that described above as shown in FIG. 4.

As shown in FIG. 7, the roller 11 is arranged between the rotary cutting blade 1 and the roller guide 8, and the roller 11 is in pressure-contact under an appropriate pressure with the roller guide 8 through the rotary cutting blade 1 by the action of spring force B of a pressing sheet spring 10. Upon reversal of the traveling direction of the supporting member 2 (for example, when the supporting member begins from the state as shown in FIG. 6 traveling toward the right in the drawing), therefore, the traveling member 14 first moves in the roller groove 12 by a distance equal to the gap F, i.e., until the traveling member 14 hits the opposite wall in the roller groove 12. Upon stoppage for the traveling member 14, the roller 11 rotates under the effect of frictional force with the roller guide 8 in this state, and the rotation of the roller 11 in turn causes the rotary cutting blade 1 to rotate. The roller 11 has the function, as described above, of communicating rotational force to the rotary cutting blade 1 by means of frictional force occurring between the roller 11 and the roller guide 8 and between the roller 11 and the rotary cutting blade 1. It is therefore desirable to maintain the state in which appropriate frictional force can be generated on the back surface of the rotary cutting blade 1 and the surface of the roller 11 as well as on the surface of the roller guide 8.

Operation of the sheet material cutter having the construction as mentioned above will now be described with reference to FIG. 4.

In FIG. 4, the case where the supporting member 2 moves toward the left as indicated by an arrow in the drawing along the frame 3 will be described below. When the motor M shown in FIG. 4 is actuated to cause the screw shaft 6 to rotate, and the supporting member 2 moves toward the left in FIG. 4, the traveling member 14 has already reached the right-hand end in the roller groove 12 as shown in FIGS. 6 and 8, whereby the shaft 9 of the rotary cutting blade 1 inclines in the traveling direction as shown in FIGS. 4 and 8, and the rotary cutting blade 1, being supported at the points P and Q (see FIG. 6), are always pressed against the contact point P with the fixed cutting blade 4.

When the supporting member 2 further continues to move toward the left along the frame 3, the roller 11 is rotated by frictional force with the roller guide 8, and the rotation of the roller 11 in turn causes the rotary cutting blade 1 to rotate in the traveling direction of the supporting member 2. The rotary cutting blade 1 thus rotates while the supporting member 2 moves toward the left, and must the sheet material located between the rotary cutting blade 1 and the fixed cutting blade 4 by the cooperation of the both cutting blades while maintaining as appropriate angle between the fixed cutting blade 4 and the rotary cutting blade 1. When cutting of the sheet material is completed and the supporting member 2 reaches an end of the screw shaft, the supporting member 2 remains in this state until the next sheet material is fed.

When the sheet material is fed, the screw shaft 6 is rotated by the motor M in the direction opposite to that described above. This rotation causes the supporting member 2 to begin traveling to the right in the drawing. At this moment, a gap F is produced between the traveling member 14 and the roller groove 12 as shown in FIGS. 6 and 8. During the initial travel of the supporting member 2, therefore, the traveling member 14 moves in the roller groove 12 by the distance equal to the gap F, or until the traveling member 14 hits the opposite wall in the roller groove 12, whereby the shaft 9 of the rotary cutting blade 1 inclines in the direction opposite to that before as shown in the right-hand portion of FIG. 4, and at the same time, the rotary cutting blade 1 is supported at the point opposite to the point Q having so far supported same so that the rotary cutting blade is always pressed against the contact point P' with the fixed cutting blade 4.

When the supporting member 2 further continues to move to the right along the frame 3 in this state, the roller 11 rotates under the effect of frictional force with the roller guide 8, and the rotation of the roller 11 in turn causes the rotary cutting blade 1 to rotate in the traveling direction of the supporting member 2. It is thus possible, while the rotary cutting blade 1 rotates as the supporting member 2 moves to the right, and the fixed cutting blade 4 and the rotary cutting blade 1 keeps an appropriate angle there between, to cut the sheet material located between the two cutting blades by the cooperation of the both cutting blades. When cutting of the sheet material is completed, and the supporting member 2 reaches an end of the screw shaft 6, the supporting member 2 remains in this state until the next sheet material is fed.

In this embodiment, as described above, it is possible, upon reversal of the traveling direction of the supporting member 2, to forcedly cause the shaft 9 of the rotary cutting blade 1 to incline through movement of the traveling member 14. This permits minimization of the play inevitable when reversing the traveling direction as in the first embodiment, and hence achievement of more efficient cutting of the sheet material. It is furthermore possible to cut the sheet material with the rotary cutting blade 1 both in forward and backward motions of the supporting member 2 on the screw shaft, and also to cause the rotary cutting blade 1 to incline at a appropriate angle to the fixed cutting blade 4 in response to the traveling direction of the supporting member 2. This not only improves the cutting efficiency of the sheet material, but also gives a very clear cut surface.

It is needless to mention that, in the above-mentioned embodiment, the angle between the fixed cutting blade and the rotary cutting blade can be freely changed by altering the roller diameter, and the supporting member 2 can be made reciprocative along the screw shaft without switching over the rotating direction of the motor by using a screw shaft having continuous right and left spirals, just as in the case of the first embodiment.

The means to cause the supporting member to make forward and backward motions is not limited to the screw shaft, but any of various other means such as a belt or a wire may be employed.

The present invention may be implemented in various other forms of embodiment without deviating from the spirit or the main features thereof. The above-mentioned embodiments are therefore only a few examples and should not be construed as limiting. All variations and alterations falling under the scope of equivalents to the patent claims come under the scope of the present invention.

According to the sheet material cutter of the present invention, as described above in detail, it is possible to satisfactorily cut a strip-shaped sheet material such as paper, with a very simple construction, by the cooperation of the rotary cutting blade moving while rotating and the roller and the roller guide for causing the rotary cutting blade to rotate, while simply causing the rotary cutting blade to incline by an angle necessary for cutting, both in forward and backward motions of the rotary cutting blade, thus providing industrially useful effects.

Further variations and modifications after forgoing will be apparent to those skilled in the art and are intended to be encompassed by the claims appended hereto.

Japanese priority application Nos. 3-339402/1991 and 4-2295/1992 are relied on and incorporated by reference.

What is claimed is:

1. A sheet material cutter comprising: a frame; a supporting member provided slidably to said frame; a rotary cutting blade supported on said supporting member; a fixed cutting blade arranged on the frame in contact with said rotary cutting blade; and a roller supported on said supporting member and arranged between said rotary cutting blade and the frame; wherein the circumferential surface of the roller is pressed onto both the rotary cutting blade and the frame, the rotary cutting blade and the roller are on different axes and the rotary cutting blade is pressed onto the fixed cutting blade so that the movement of the supporting member relative to the frame causes the roller to rotate, whereby a sheet material introduced between the rotary cutting blade and the fixed cutting blade is cut.

2. A sheet material cutter as claimed in claim 1, wherein said supporting member further comprises a roller groove having two end portions, said roller is arranged in the roller groove and movable between said two end portions of the groove, and wherein the rotary cutting blade is pressed onto the fixed cutting blade when said roller reaches any one of said end portions of said groove.

3. A sheet material cutter as claimed in claim 2, wherein the rotary cutting blade comprises a shaft which can be inclined toward either movable direction of the supporting member, and further wherein the shaft inclines toward the moving direction of the supporting member, when said roller reaches any one of said end portions of said groove.

4. A sheet material cutter as claimed in claim 3, wherein the roller moves from one of said end portions to the other when the supporting member reverses its moving direction.

5. A sheet material cutter as claimed in claim 1, wherein the rotary cutting blade comprises a shaft which is inclined toward either movable direction of the supporting member.

6. A sheet material cutter as claimed in claim 1, wherein the frame further comprises a roller guide, and the roller is pressed onto both the rotary cutting blade and the roller guide.

7. A sheet material cutter comprising: a frame; a fixed cutting blade attached to the frame; a supporting member provided slidably to the frame; a rotary cutting blade; and a traveling member supported on said supporting member wherein the traveling member reciprocates in the traveling direction of said supporting member; wherein said rotary cutting blade further comprises a shaft having an end that is pivotally connected to the traveling member, wherein said supporting member further comprises a roller groove formed on the supporting member and a roller provided in the traveling member, wherein the traveling member is slidably arranged in said groove, the roller is pressed onto the rotary cutting blade and the frame causing the rotary cutting blade to rotate in accordance with the movement of the supporting member which causes the traveling member to slide within the groove to cause the shaft of said rotary cutting blade to incline such that the rotary cutting blade is pressed onto the fixed cutting blade.

8. A sheet material cutter as claimed in claim 7, wherein said traveling member further comprises a supporting arm whereto said end of the shaft is pivotally connected.

9. A sheet material cutter as claimed in claim 7, wherein said roller groove comprises two end walls which the traveling member reaches and stops when the movement direction of the supporting member is changed, and, upon stoppage of the traveling member, the rotation of the roller has the rotary cutting blade rotate and the shaft of the cutting blade incline toward the moving direction of the supporting member.

10. A sheet material cutter as claimed in claim 7, wherein the supporting member comprises a pressing spring which presses the rotary cutting blade onto the roller and the fixed cutting blade.

11. A sheet material cutter as claimed in claim 7, wherein the frame comprises a roller guide, and the roller is pressed onto the rotary cutting blade and the roller guide.

12. A sheet material cutter comprising: a frame; a supporting member provided slidably to said frame; a rotary cutting blade supported on said supporting member; a shaft connected to said rotary cutting blade; a fixed cutting blade arranged on the frame in contact with said rotary cutting blade; a roller guide formed on said frame; a traveling member arranged slidably in a roller groove formed in said supporting member; a supporting arm for connecting said traveling member and an end of the shaft of said rotary cutting blade; and a roller which is housed in said traveling member and is arranged between the rotary cutting blade in contact with the back surface of the rotary cutting blade and the roller guide formed on said frame; whereby the travel of the supporting member relative to the frame causes the traveling member to move in the roller groove and the roller to rotate, the rotation of the roller causes the rotary cutting blade to rotate in the cutting direction of the sheet material, and the rotary cutting blade being pressed by a pressing means onto the fixed cutting blade.

13. A sheet material cutter comprising: a frame, a supporting member provided slidably to said frame; a rotary cutting blade supported on said supporting member; a fixed cutting blade arranged on the frame in contact with said rotary cutting blade; and a roller supported on said supporting member and arranged between said rotary cutting blade and the frame; wherein the circumferential surface of the roller is pressed onto both the rotary cutting blade and the frame, the rotary cutting blade and the roller are on different axes and the rotary cutting blade is pressed onto the fixed cutting blade so that the movement of the supporting member relative to the frame causes the roller to rotate, whereby a sheet material introduced between the rotary cutting blade and the fixed cutting blade is cut, wherein the supporting member comprises a pressing spring which presses the rotary cutting blade onto the roller and the fixed cutting blade.

* * * * *